US012680251B2

(12) United States Patent
Azmey et al.

(10) Patent No.: US 12,680,251 B2
(45) Date of Patent: Jul. 14, 2026

(54) PORTABLE WORKING DECK

(71) Applicants: Adel Azmey, Tomball, TX (US); Joe Joe Chellakat Satyaraj, Cochin (IN)

(72) Inventors: Adel Azmey, Tomball, TX (US); Joe Joe Chellakat Satyaraj, Cochin (IN); Sulaiman Rawther Ashik Subahani, Thonnallur Pandalam (IN)

(73) Assignees: Adel Azmey, Tomball, TX (US); Joe Joe Chellakat Satyaraj, Cochin (IN)

( * ) Notice: Subject to any disclaimer, the term of this patent is extended or adjusted under 35 U.S.C. 154(b) by 111 days.

(21) Appl. No.: 18/614,648

(22) Filed: Mar. 23, 2024

(65) Prior Publication Data

US 2024/0318395 A1 Sep. 26, 2024

(51) Int. Cl.
*E02B 17/00* (2006.01)
*E02B 17/02* (2006.01)

(52) U.S. Cl.
CPC .... *E02B 17/021* (2013.01); *E02B 2017/0056* (2013.01)

(58) Field of Classification Search
CPC .... E21B 17/021; E21B 15/003; E02B 17/021; B63B 2003/485
See application file for complete search history.

(56) References Cited

U.S. PATENT DOCUMENTS 4,483,644 A * 11/1984 Johnson ..... E02B 17/021 175/9
5,042,612 A * 8/1991 Bennett ..... B65G 69/22 182/1
5,229,653 A * 7/1993 Lamarche ..... H03K 17/9547 307/127
6,932,553 B1 * 8/2005 Roodenburg ..... E21B 15/003 166/343
8,566,992 B1 10/2013 Stokes
2012/0006618 A1 * 1/2012 DuBose ..... B60P 3/226 182/112

(Continued)

FOREIGN PATENT DOCUMENTS

NO 20171677 A1 10/2018

OTHER PUBLICATIONS

Extended European Search Report for EP Application 23164203.4, provided by the European Patent Office on Aug. 29, 2023.

*Primary Examiner* — Carib A Oquendo
(74) *Attorney, Agent, or Firm* — Jose Cherson Weissbrot

(57) ABSTRACT

A working deck configured to access offshore well heads, comprising: a barge, transverse beams fixed to an upper surface of the barge, wherein the working deck comprises cantilever beams attachable to the transverse beams, and a work platform positioned on the cantilever beams and movable in a lateral direction of the cantilever beams wherein the transverse beams are oriented perpendicular to a forward direction of the barge and comprise at least one of a track beam and one of a hold-down beam for receiving the cantilever beams, wherein the cantilever beams can be moved along the at least one track beam and the hold down beam to change the position of the cantilever beams relative to the barge, wherein the working deck comprises stiffening elements for stiffening the hold-down beam and to prevent or limit deformation of the hold-down beam.

23 Claims, 9 Drawing Sheets

(56) References Cited

U.S. PATENT DOCUMENTS

| | | | | |
|---|---|---|---|---|
| 2014/0262504 | A1* | 9/2014 | Seng | E21B 7/12<br>182/36 |
| 2015/0121635 | A1* | 5/2015 | Prins | B63B 27/14<br>14/71.1 |
| 2019/0084654 | A1* | 3/2019 | Nøstvold | B63B 27/143 |

* cited by examiner

PORTABLE WORKING DECK

PRIORITY

This application claims priority under 35 U.S.C. § 119 to European patent application EP23164203.4, filed Mar. 25, 2023, the disclosure of which is incorporated herein by reference.

FIELD OF THE INVENTION

The invention relates to working decks in general and a portable working deck to access offshore well heads in particular.

BACKGROUND

Oil and gas well heads must be serviced and/or must be assessed for a different number of reasons. For example, valves or seals in the oil and gas well heads may need to be replaced, flanges may need to be removed or installed in the oil and gas well heads, and blowout preventers may need to be removed, added, or serviced.

The U.S. Pat. No. 6,926,097 B1 discloses an offshore jack-up workover rig for servicing of oil and gas wells. The workover rig includes a vessel which may be self-powered or powered by a tug. The vessel may be raised above the surface of a water body by extending the legs until they reach the water body bed and then continuing to extend the legs. The workover rig of this patent contains a workover floor unit which includes at least a winch, a winch motor, and a well aperture. The workover rig is detachably mounted on an extensible cantilevered frame. The frame may be extended to position the workover floor unit over an offshore platform to be serviced. The workover floor unit is also configured to mover laterally relative to the extensible frame. The vessel is also provided with a crane. The crane may be used to lift the detachable workover floor unit from the vessel and install it, including its equipment, on the platform.

Limitations regarding the structures of servicing or maintenance decks, such as conventional single deck Texas decks, are known which require a lot of the barge deck space to be utilized for rigging up/down offshore. Beams for supporting the structure are required to penetrate deep into the main deck of the barge which can cause a delay in cast off/release of the barge in case of an emergency. Shipping the conventional Texas deck into or from the barge is challenging due to the limited space on the barges to accommodate the deck, support beams and gangway. In addition, it is difficult to access offshore well heads, supported only with jacket frames at main sea level.

The servicing of well heads is carried out in some cases by drilling and workover rigs. However, the costs for hiring and operating the drilling and workover rig for the servicing is significantly high.

The Texas deck is a specific deck on an offshore jack-up drilling rig. It is located below the rotary table and rig floor. Workers use this deck to access the BOP (Blowout Preventer) stack. The platform surrounds the base of the BOP stack and is suspended from the cantilever where the rig floor is situated by adjustable cables. Access to the Texas deck is typically via a semipermanent stairwell from the main deck of the jack-up barge/rig.

The Texas deck is primarily used for installing the wellhead and manipulating the BOP stack, namely by raising or lowering it. When drilling operations are underway, this deck plays a crucial role in ensuring well integrity and safety. It facilitates the connection of the BOP stack to the wellhead, which is essential for well control during drilling and completion activities.

So, the Texas deck is where critical well control equipment is accessed and operated, contributing to safe and efficient drilling, completion and well interventions operations in offshore environments.

When it comes to well operations as well completions and intervention the Texas deck on offshore rigs, there are some important considerations and limitations:

Regarding the maneuverability of a Texas Deck there is no consideration for the potential need to adjust the positioning of the working platform to evenly accommodate all wells on location. This could be required if barge/vessel approach and positioning is not ideal as planned.

The inability to reposition the working platform around well slot could limit the accessibility to wellheads Christmas tree, because well orientation and/or the direction of Christmas tree valves which could impose a specific way of rigging up the fit for purpose equipment in preparations for the required scope of work.

There are also space constraints. The Texas deck is a relatively small area on the rig. Limited space can make it challenging to perform complex well intervention tasks efficiently. Workers need to carefully plan their movements and equipment placement to avoid congestion.

Additionally, while the Texas deck provides access to the BOP stack, it may not accommodate all necessary intervention equipment. Larger tools or machinery might be difficult to position and operate within this confined space. Rig crews must prioritize essential equipment and ensure it fits comfortably on the deck.

The Texas deck is situated near critical well control components. Any intervention work carries inherent risks, especially when dealing with high-pressure systems. Rig personnel must adhere to strict safety protocols to prevent accidents or equipment damage.

Further, offshore rigs operate in dynamic environments with changing weather and sea states. Rough seas, strong winds, or adverse conditions can impact well intervention activities on the Texas deck. Crews must be vigilant and adapt their procedures accordingly.

Routine maintenance and inspections are essential for the Texas deck and associated equipment. Ensuring proper functionality of the BOP stack, cables, and other components is crucial. Regular checks help identify any issues early and prevent operational disruptions.

The Texas deck interacts with other rig decks, such as the main deck and rig floor. Effective communication and coordination are vital to avoid conflicts or delays. Rig crews must synchronize activities across different levels to maintain operational efficiency. In summary, while the Texas deck facilitates critical wellhead installation and BOP manipulation, its limitations require careful planning, safety awareness, and efficient use of available space.

NO20171677A1 discloses a cantilever structure for use in well intervention operations. The cantilever structure is arranged on a platform deck of a jack-up rig or a liftboat and is movable relative to the platform deck.

U.S. Pat. No. 6,932,553B1 discloses a multipurpose system for a drilling and well intervention made of pivotable, slidable cantilever on platform adapted to pivot and to slide along an x-y axis.

U.S. Pat. No. 8,566,992B1 discloses a method and apparatus for providing an extendable and retractable work platform from a work vessel. The apparatus comprises of first and second platform support frames with associated decking surfaces.

It is an object to present a cost effective solution, for the access of the oil and gas wells, for well services, maintenance or other scope of well operations while ensuring and maintaining flexibility and safety in operations. The solution should be simple and portable in order to be installed or uninstalled quickly and safely.

SUMMARY

This document discloses a working deck configured to access offshore well heads, wherein the working deck comprises a barge, transverse beams fixed to an upper surface of the barge, at least two cantilever beams attachable on to the transverse beams, and a work platform positioned on the at least two cantilever beams and being movable in a lateral direction of the cantilever beams.

In one aspect, the transverse beams are oriented perpendicular to a forward direction of the barge. This orientation of transverse beams supports the stability of the whole construction while moved to the working location and saves space on the barge.

In another aspect, the transverse beams comprise at least one of a track beam and one of a hold-down beam for receiving the at least two cantilever beams.

In another aspect, the at least two cantilever beams are connected with a link beam mounted between them. The link beam guarantees the stability of the cantilever beams and makes sure that the cantilever beams are oriented parallel to each other.

In another aspect, the at least two cantilever beams further comprise rollers for rolling on the at least one track beam of the transverse beams, and further comprise sliders, for sliding along the hold-down beam of the transverse beams. The at least two cantilever beams are able to be moved along the at least one track beam and the hold down beam to change the position of the at least two cantilever beams relative to the barge.

Cantilever beams are designed to move horizontally or laterally not longitudinally. Unlike the current or conventional Texas decks installed on rigs/barges or vessels at which cantilever is arranged on the deck and is movable back and forth on the deck, during such movement one end of the cantilever structure can be extended beyond the perimeter of the rig deck. Subsequent to the intervention operation the cantilever structure can be retracted back onto the rig deck. Then the entire jack-up rig is removed and transported to a different location. This is not the case here with the projected solution due to the capability of having the cantilever beams to move laterally/horizontally which facilitates the flexibility of changing the working position of the working deck without the need to move the whole barge/vessel in a lateral direction after jacking down to the desired working level/position, hence accessing the wellheads can be managed even if the well orientation or direction of the Christmas tree is imposed, which results in a specific rigging up procedures are not necessary.

In another aspect, the at least one track beam further comprises C-clamps for holding a position of the at least two cantilever beams on the at least one track beam. With the C-clamps the at least two cantilever beams can be fixed relative to the at least one track beam.

In another aspect, the work platform further comprises of removable floor panels for accessing the well heads. The floor panels can be removed as desired for an easier access of wells at different positions. Thus, the work platform itself is adjustable and more flexible for accessing the well heads. Unlike other work structures which require to be moved by a piston arrangement, a hydraulic cylinders or rotating lifting screw, relying on the changing position of the whole structure by retracting or extending one end in order to access the wellheads at different positions.

In another aspect, the work platform further comprises at least one wheel driven by at least one electromotor for moving the work platform on rails of the at least two cantilever beams. The work platform can, thus, be moved or re-positioned in a lateral direction along the at least two cantilever beams to access a desired horizontal working position.

In another aspect, the working deck is not telescopically extendable, but its operations relying on rollers/wheels operated by electric motors for controlling the movement in a lateral direction of the cantilever beams.

In another aspect, the working deck further comprises a gangway positioned on the at least two cantilever beams, comprising a stair member and a length-adjustable platform member.

In another aspect, the working system portable working deck with the cantilever beams is not a fixed structure on the rig/vessel/barge but a portable part that can be shipped and assembled offshore on the vessel/barge when required based on the scope of work.

The cantilever beams with the working deck can be assembled and dismantled at site. The entire unit is able to store it in a 40 ft ISO container and can be transported to site easily. This also enables the unit to transport any part of the world separately and assembled onsite for the desired operation when needed. Unlike other structures that require the cantilever structure to be retracted back on the rig/vessel then the entire jack up rig/vessel/barge can be removed and transported to a different location. Which Means these other cantilever structure cannot be disassembled on site, nor taken apart. Hence not considered portable.

In another aspect, the barge further comprises a jack-up mechanism for jacking-up the barge above the well heads and for jacking-down the barge to a desired vertical working position.

A method for accessing an offshore well heads with a working deck is also disclosed. The method comprises the steps of positioning a barge next to the offshore well head, jacking-up the barge to a height above the offshore well head, mounting a link beam between at least two cantilever beams, attaching the at least two cantilever beams to transverse beams fixed to the barge, positioning a work platform with floor panels on the at least two cantilever beams, electrically connecting at least one electromotor of the work platform, moving the work platform in a lateral direction to the at least two cantilever beams to a desired horizontal working position by using the at least one electromotor, positioning a gangway on the at least two cantilever beams between the barge and the work platform, removing of ones of the floor panels at the work platform for accessing the offshore well head, and jacking-down the barge over the offshore well heads to a desired vertical working position.

In one aspect, the positioning of the at least two cantilever beams on the transverse beams is carried out in such a way that rollers of the at least two cantilever beams roll on at least two track beams of the transverse beams and a slider of the at least two cantilever beams slides along a hold-down beam of the transverse beams.

In another aspect, the method further comprises fixing the at least two cantilever beams attached to the transverse beams with C-clamps.

DETAILED DESCRIPTION OF THE INVENTION

The invention will now be described on the basis of the drawings. It will be understood that the embodiments and aspects of the invention described herein are only examples and do not limit the protective scope of the claims in any way. The invention is defined by the claims and their equivalents. It will be understood that features of one aspect or embodiment of the invention can be combined with a feature of a different aspect or aspects and/or embodiments of the invention.

Figure 1:
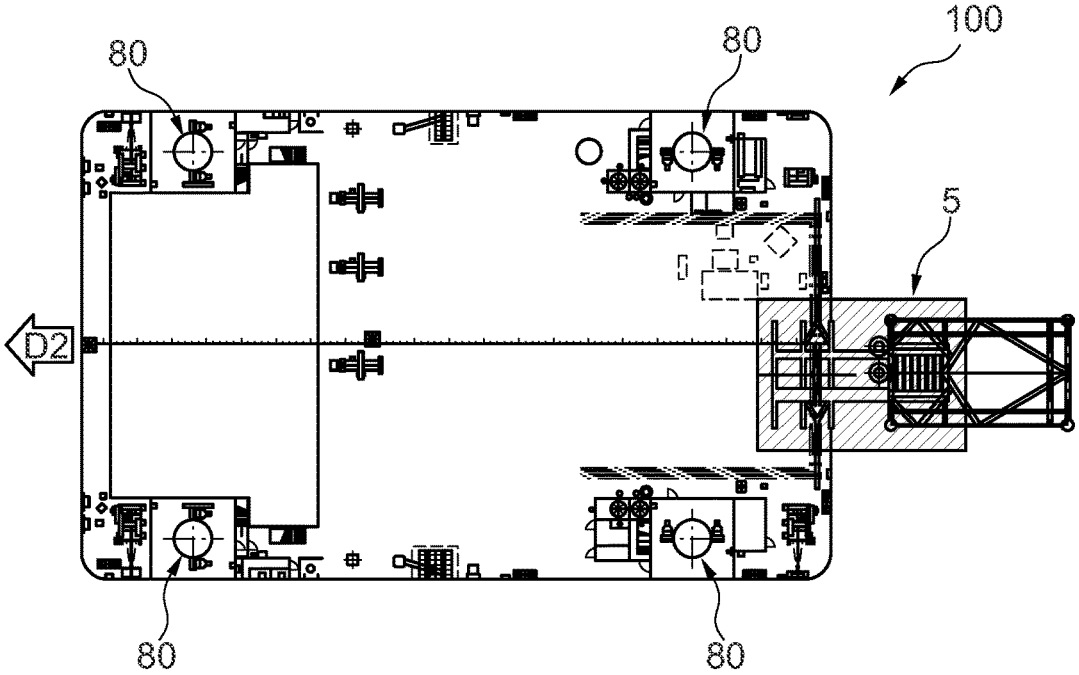
FIG. 1 shows a working deck at an offshore working location seen from above.

FIG. 1 shows a working deck 100 at an offshore working location as seen from above. A barge 10 comprises jack-up mechanisms 80 for jacking-up the barge 10 after the barge 10 was moved to the offshore working location. The jacking-up mechanism 80 is one of a known art and will be not described in detail hereinafter. A maintenance area 5 is located in a rear end relative to a forward direction D2 of the barge 10. The barge 10 can be any of a floating vessel comprising a platform or a deck with and without its own drive. With other words, the barge 10 can drive on its own or be drawn by another vessel, for example a boat, to the offshore working location.

Figure 2:
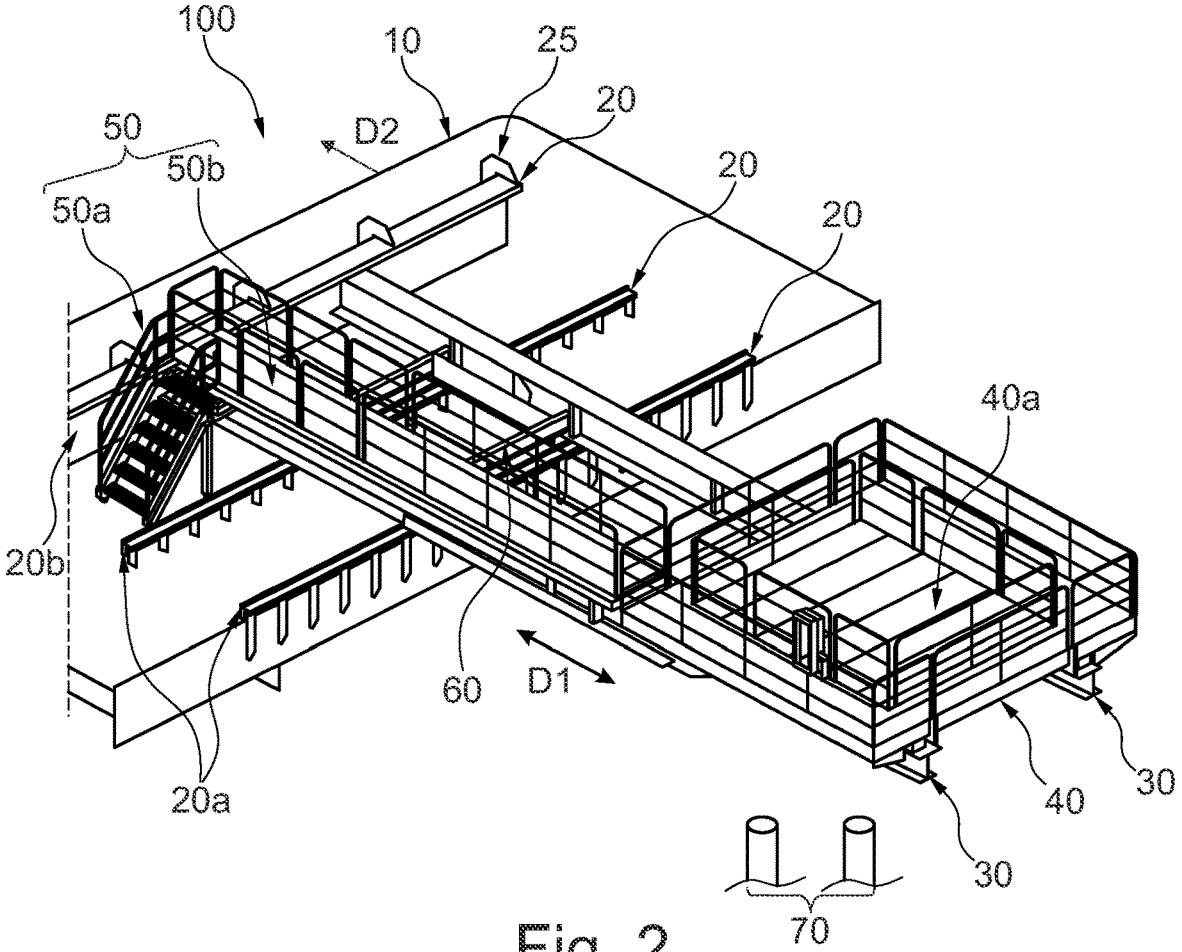
FIG. 2 shows the part of the working deck of FIG. 1 in a perspective view.

FIG. 2 shows the working deck 100 in operation in a perspective view. The working deck 100 is configured to access offshore well heads 70 of an offshore well head platform. It can be seen that the working deck 100 comprises in addition to the barge 10, further components, such as transverse beams 20 with at least one of a track beam 20*a* and one of a hold-down beam 20*b*, a plurality of stiffening elements 25, at least two cantilever beams 30, a link beam 60, and a work platform 40. The work platform 40 has removable floor panels 40*a* and is positioned on the cantilever beams 30. The work platform 40 is movable in a lateral direction D1 of the cantilever beams 30. The working deck 100 further comprises a gangway 50 comprising a stair member 50*a* and a length-adjustable platform member 50*b*.

Figure 3:
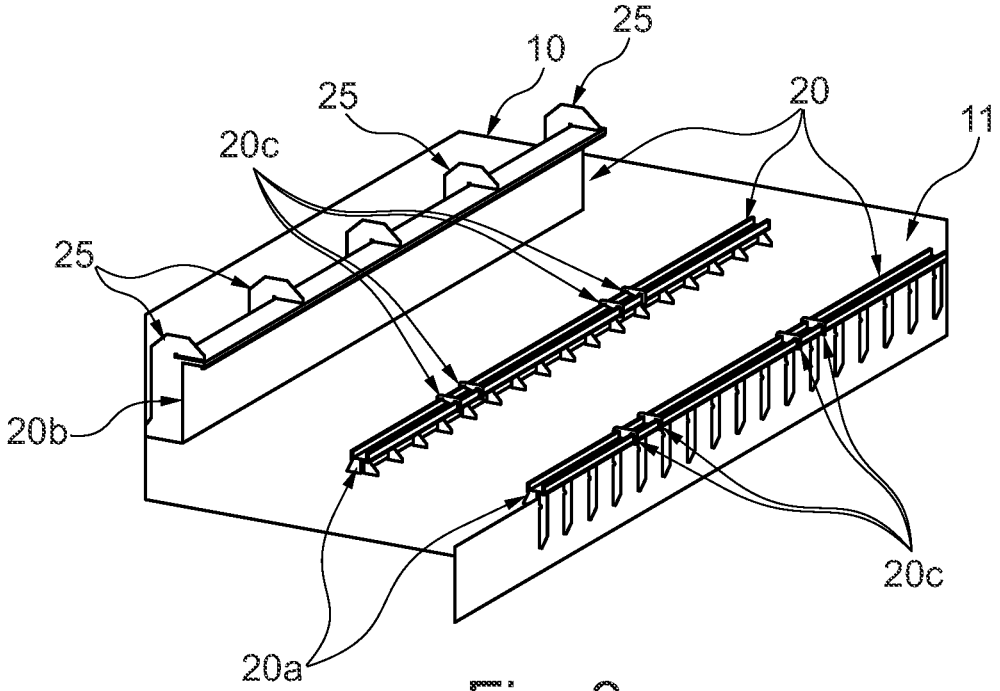
FIG. 3 shows transverse beams of the working deck fixed to the barge.

As seen in FIG. 3, the transverse beams 20 are fixed to an upper surface 11 of the barge 10. The transverse beams 20 are made of a weldable metal such as for a non-limiting example steel. The upper surface 11 of the barge 10 is a surface in general parallel to the surface of the water on which the barge 10 is floating. The two track beams 20*a* and the hold-down beam 20*b* are fixed to the upper surface 11 of the barge 10 by, for example, welding.

The two track beams 20*a* are in the form of a rail, but this is not limiting of the invention. The two cantilever beams 30 are affixed at a desired position on the track beams 20*a* using C-clamps 20*c* which position the two cantilever beams 30 onto the track beams 20*a*. FIG. 3 shows a total of eight C-clamps 20*c*, but this is not limiting of the invention. The eight C-clamps 20*c* are in four pairs of two C-clamps 20*c*. A first two pairs are arranged on a first one of the track beams 20*a* and a second two pairs are arranged on a second one of the track beams 20*a*. The cantilever beams 30 can then be disposed and affixed between the pairs of the C-claims 20*c*. In this manner, the relative position of the cantilever beams 30 to the barge 10 can be chosen and fixed before placing the two cantilever beams 30. Alternatively, the C-clamps 20*c* can also be affixed onto the track beams 20*a* after the cantilever beams 30 are assembled to the transverse beams 20. The C-clamps 20*c* are made, for example, of a metal such as steel and have the form of a letter C to cover the track beam 20*a*. The hold-down beam 20*b* comprises the plurality of stiffening elements 25 which have the function of stiffening the hold-down beam 20*b* and to prevent or limit deformation of the hold-down beam 20*b*. The stiffening elements 25 are made of a weldable metal such as steel (but this is not limiting of the invention) and are welded to the hold-down beam 20*b* and to the upper surface 11 of the barge 10. Due to the pending moment and shear forces that act on hold down beam by providing an opposing moment reaction as well a vertical reaction force to counter the shear forces.

The hold down beams 20*b* is very essential and unique part of the transverse beams structural design and its main advantages are, working as anchoring and supporting structure for the whole cantilever structure weight and stability of the whole system. The hold-down beam 20*b* comprises the plurality of stiffening elements 25 which have the function of stiffening the hold-down beam 20*b* and to prevent or limit deformation of the hold-down beam 20*b*. The hold down beam 20*b* is oriented perpendicular to a forward direction of the barge. This orientation of the hold-down beam supports the stability of the whole construction while moved to the working location. Limiting the length of penetration of the cantilever beams on the barge/vessel main deck. Which makes most of the working space of the barge/vessel main deck available for other scopes of work to be carried out in parallel or for facilitating other equipment allocations.

Figure 4:
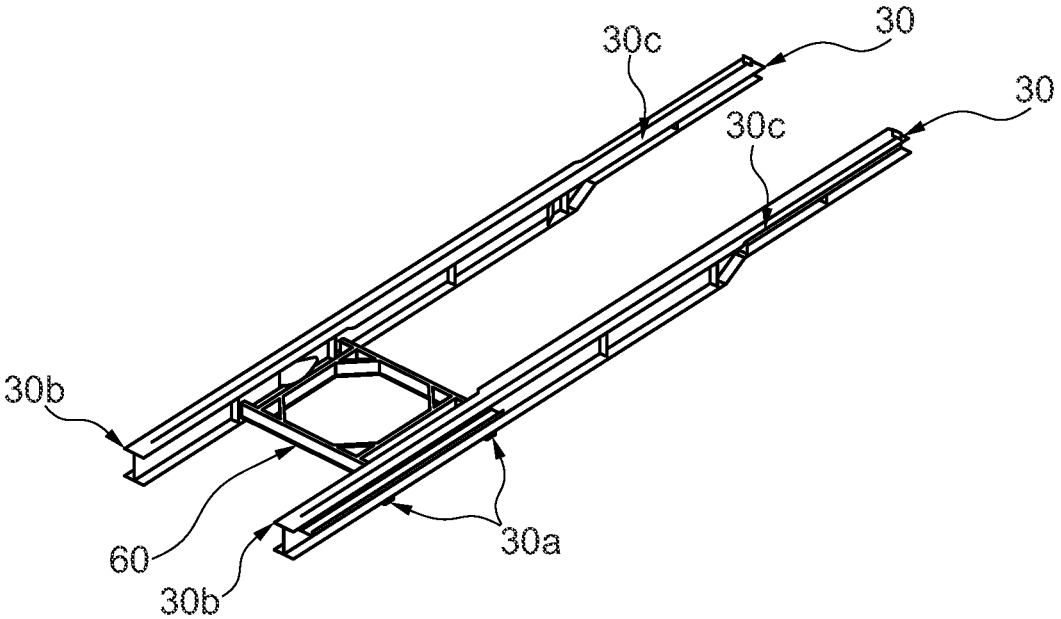
FIG. 4 shows at least two cantilever beams with a link beam mounted therebetween.

As seen in FIG. 4, two cantilever beams 30 are connected with a link beam 60 mounted between the two cantilever beams 30. The link beam 60 is for example a welded structure of metal beams which define a rigid position of the two cantilever beams 30 relative to each other. The two cantilever beams 30 have rollers 30*a*. The rollers 30*a* are designed in such a way to be able to withstand high forces and loads. It will be apparent that the rollers 30*a* are connected to the cantilever beams 30 with bearings. The rollers 30*a* enable the cantilever beams 30 to roll on the track beams 20*a*. The cantilever beams 30 further have sliders 30*b*. The sliders 30*b* enable the two cantilever beams 30 to slide along the hold-down beam 20*b*. The sliders 30*b* is a unique feature of the structural design for the cantilever beams 30 as they have the function to enable the two cantilever beams 30 to slide along the hold-down beam 20*b*. As highlighted as well in FIG. 11 indicating the engagement points between the sliders 30*b* and hold down beam 20*b* facilitating the movement of the cantilever beam 30 laterally. The sliders 30*b* are made for example of the same material as the hold-down beam 20*b* in order to reduce friction between the sliders 30*b* and the hold-down beam 20*b* when moved relative to each other. The two cantilever beams 30 further include rails 30*c*. As will be described later, the work platform 40 can be moved along the rails 30*c*.

Figure 5:
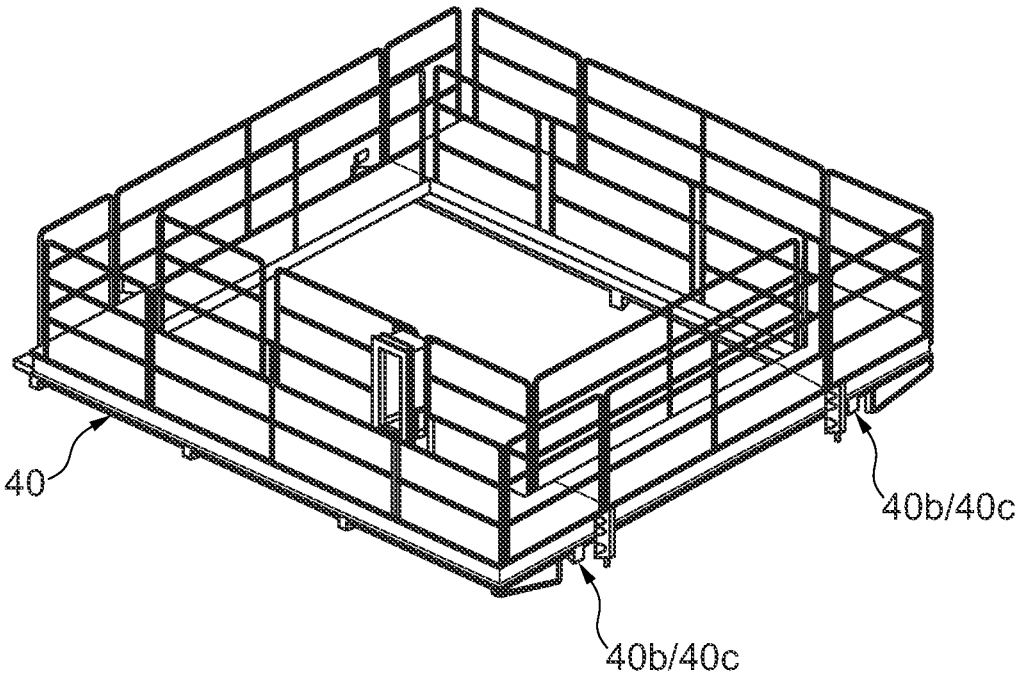
FIG. 5 shows a work platform of the working deck with removed removable floor panels.
Figure 6:
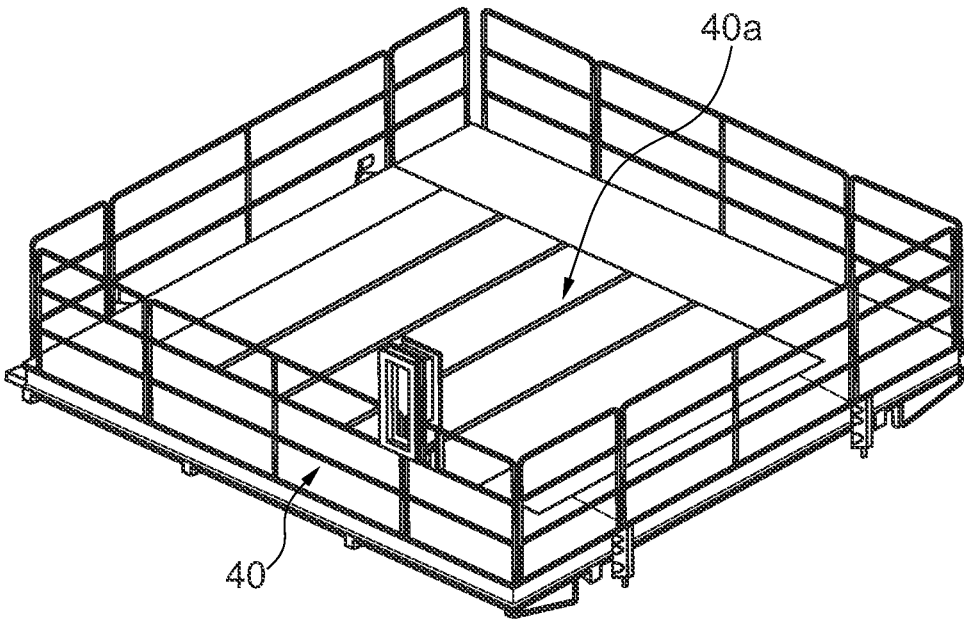
FIG. 6 shows the work platform of FIG. 5 with attached removable floor panels.

FIGS. 5 and 6 show the work platform 40 with (FIG. 5) and without (FIG. 6) the plurality of removable floor panels 40*a*. When the work platform 40 is moved to the desired working position above the well heads 70, all or a few of the removable floor panels 40*a* can be removed from the work platform 40 to access one or more of the offshore well heads 70.

The overboard work platform 40 is made up of removable floor panels 40*a* for ease of operation. Depending on the location of wellhead, and/or certain orientation for accessing such wellheads, then the floor panels 40*a* can be added and removed accordingly, which brings good flexibility to the working deck/platform for the well operations.

Unlike other conventional platforms or Texas Decks which relying on the changing position of the whole cantilever structure by retracting or extending one end of the platform over the perimeter by a piston arrangement, a hydraulic cylinders or rotating lifting screw.

The work platform 40 further comprises at least one wheel 40*b* driven by at least one electromotor 40*c*. In FIGS. 5 and 6 two wheels 40*b* are shown, but this is not limiting of the invention. The wheel/s 40*b* will be positioned on the rails 30*c* of the cantilever beams 30 for moving the work platform 40 along the cantilever beams 30 in the lateral direction D1, as can be seen in FIG. 1.

Figure 7:
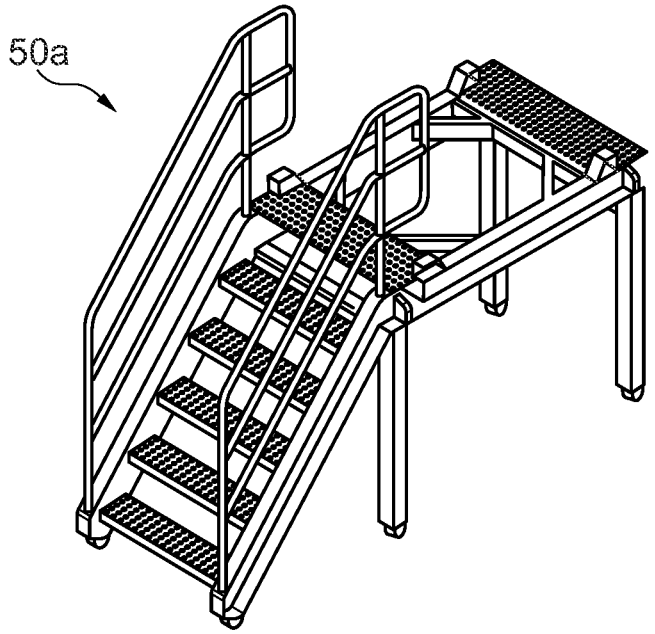
FIG. 7 shows a stair member.

In order to access the work platform 40 in a safe way the gangway 50 (see FIG. 2) is positioned onto at least one of the two cantilever beams 30 between the barge 10 and the work platform 40. FIG. 7 shows the stair member 50*a* which helps to overcome a height difference between the upper surface 11 of the barge 10 and the work platform 40 (see FIG. 2). The stair member 50*a* is, for example, a welded steel construction.

Figure 8:
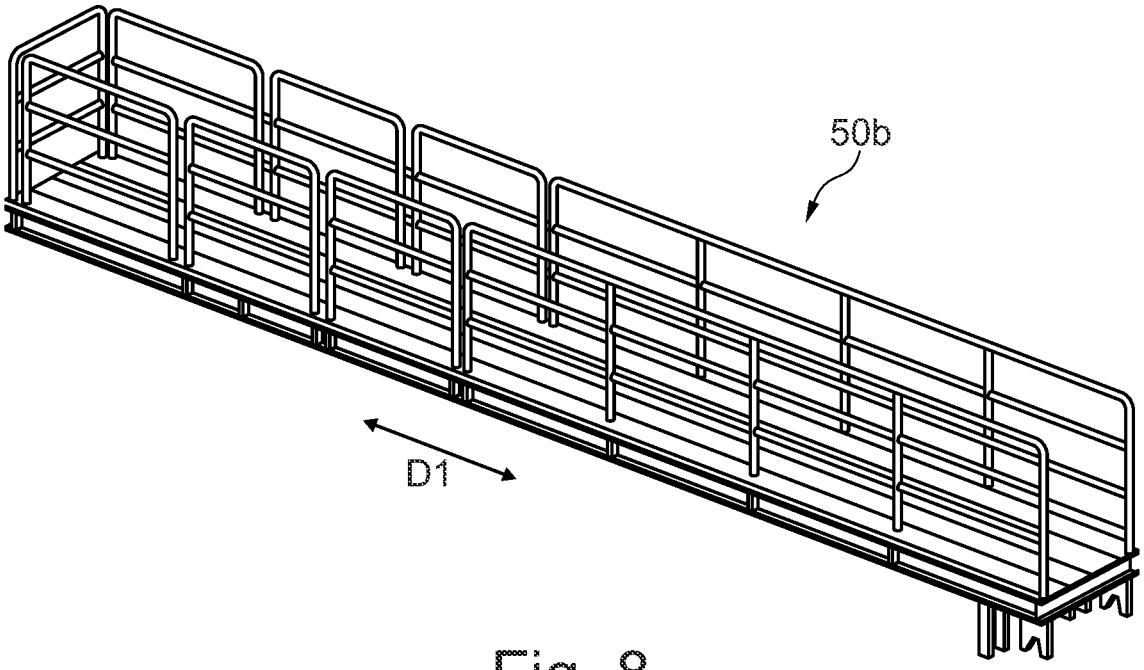
FIG. 8 shows a length-adjustable platform member.

FIG. 8 shows the length-adjustable platform member 50*b*. The length-adjustable platform member 50*b* can be adjusted in length in the lateral direction D1 for accessing the movable work platform 40 in a safe way.

Figure 9:
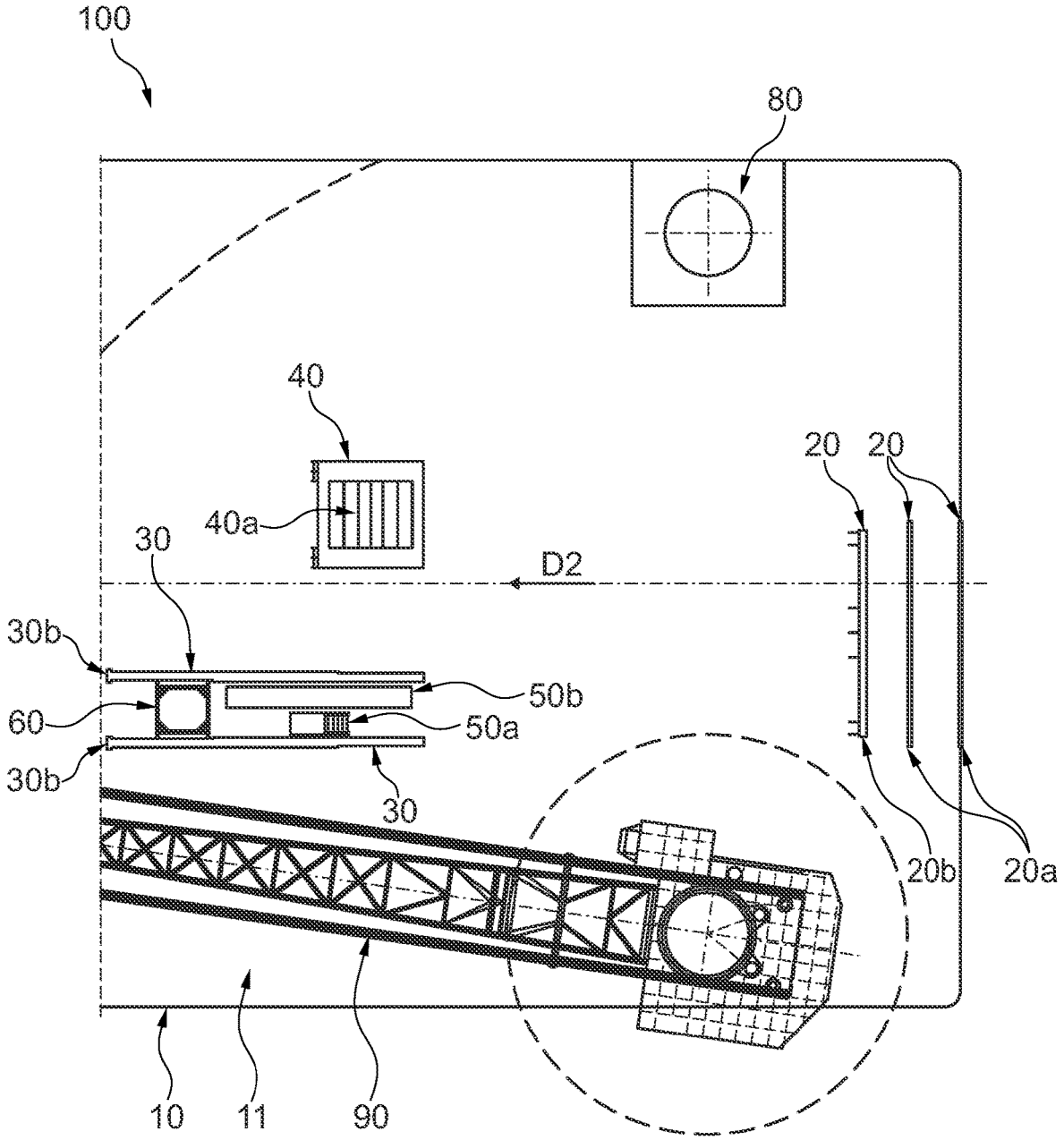
FIG. 9 shows an example of how components of the working deck are stored on the barge.
Figure 10:
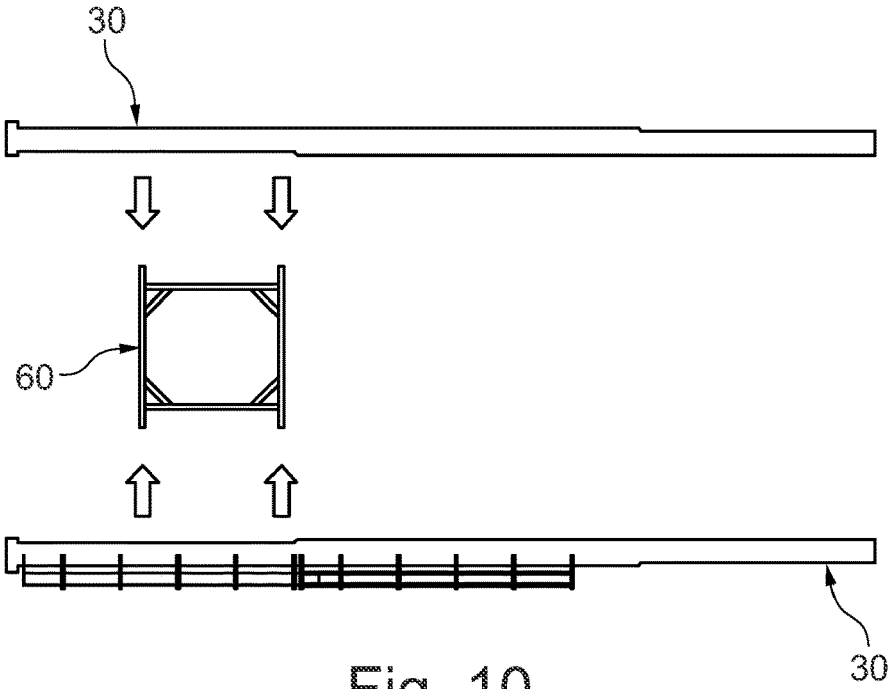
FIG. 10 shows how the link beam is mounted between the at least two cantilever beams.

FIG. 9 shows an example of how the components of the working deck 100 are stored on the upper surface 11 of the barge 10 when the components are not in use. The transverse beams 20 are oriented and fixed perpendicular to the forward direction D2 of the barge 10. The work platform 40 equipped with the removable floor panels 40*a* as well as the cantilever beams 30, the link beam 60 and the gangway 50 are disposed and secured on the upper surface 11 of the barge 10 in a location reachable with a crane 90 when the barge 10 is moving to the offshore well heads 70.

With reference to FIGS. 10 to 14 in conjunction with FIG. 15, a method 200 for accessing one or a plurality of offshore well heads 70 with the working deck 100 will be described.

Figure 15:
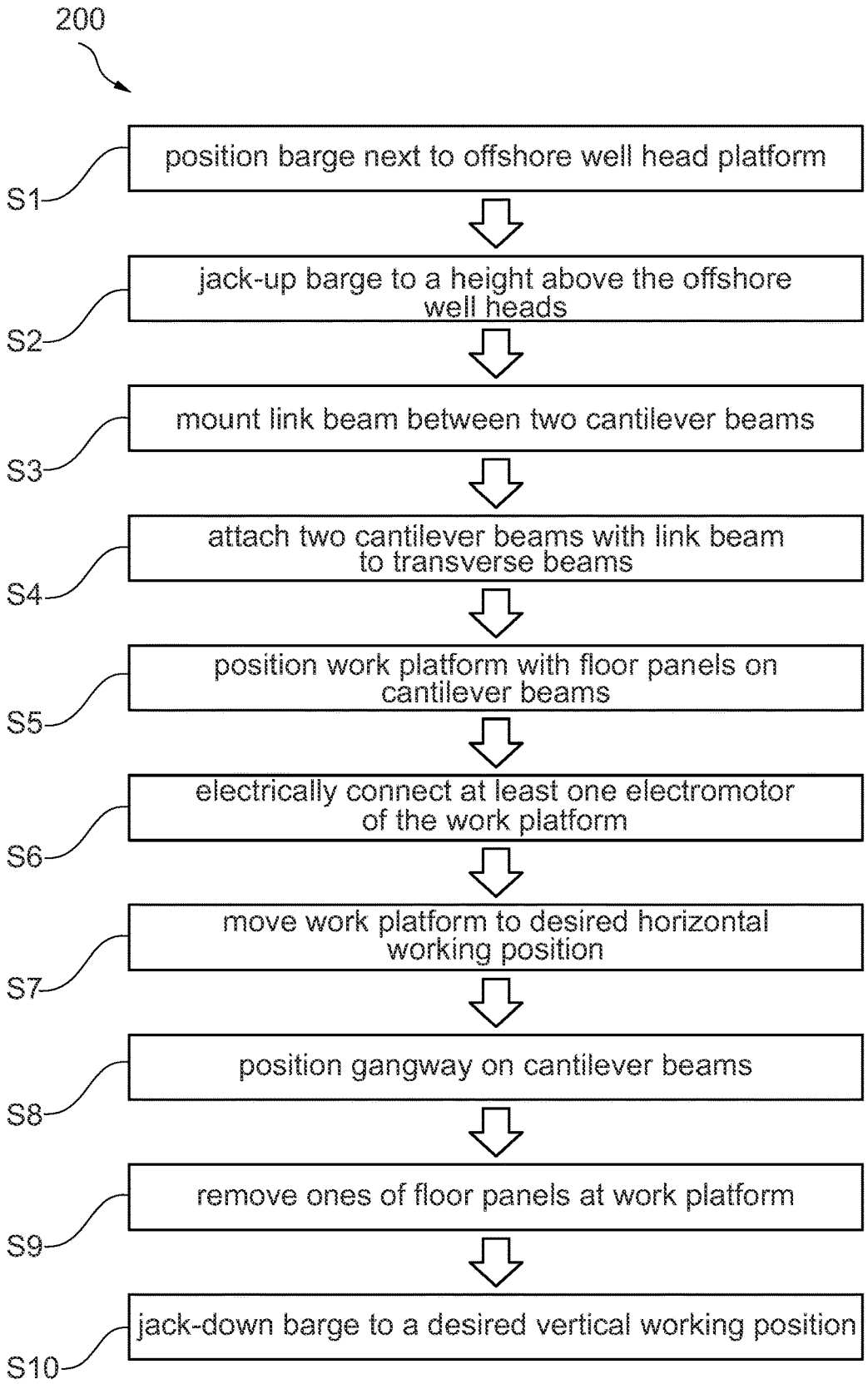
FIG. 15 shows a flowchart of a method for accessing an offshore well heads with a working deck.

In step S1 the barge 10 is positioned next to the offshore well heads 70 of the offshore well head platform and jacked-up to a height above the offshore well heads 70 in step S2 of the method 200 of FIG. 15. Following step S2 the link beam 60 is mounted between the two cantilever beams 30 in step S3 (see also FIG. 10).

Figure 11:
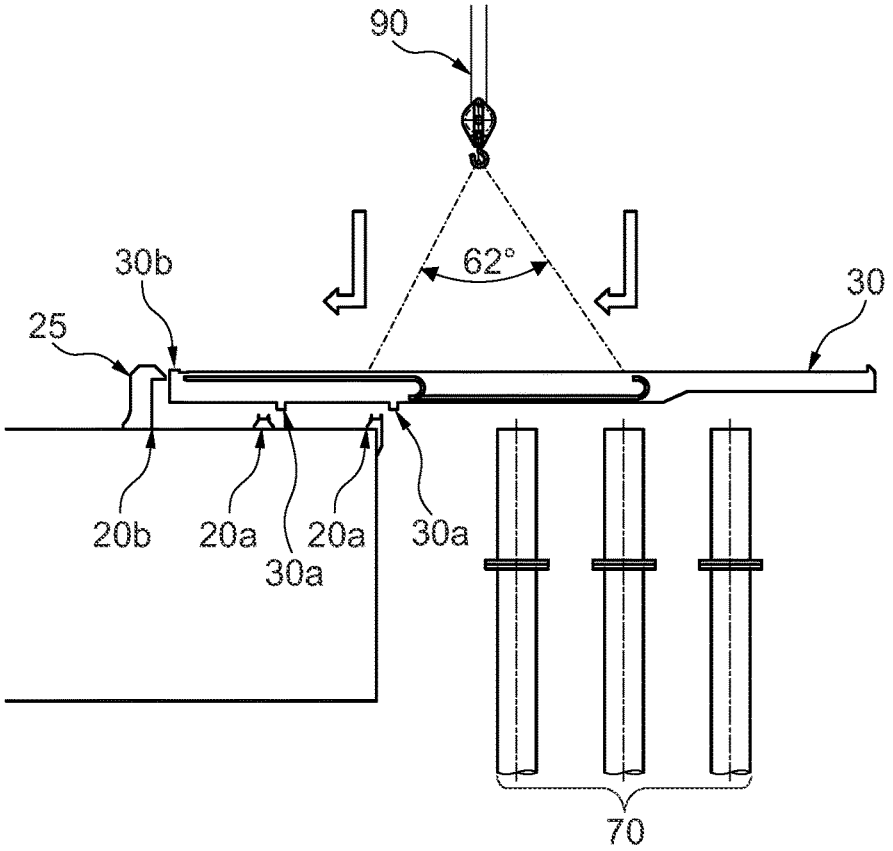
FIG. 11 shows a first assembly step of the at least two cantilever beams with link beam at the transverse beams.
Figure 12:
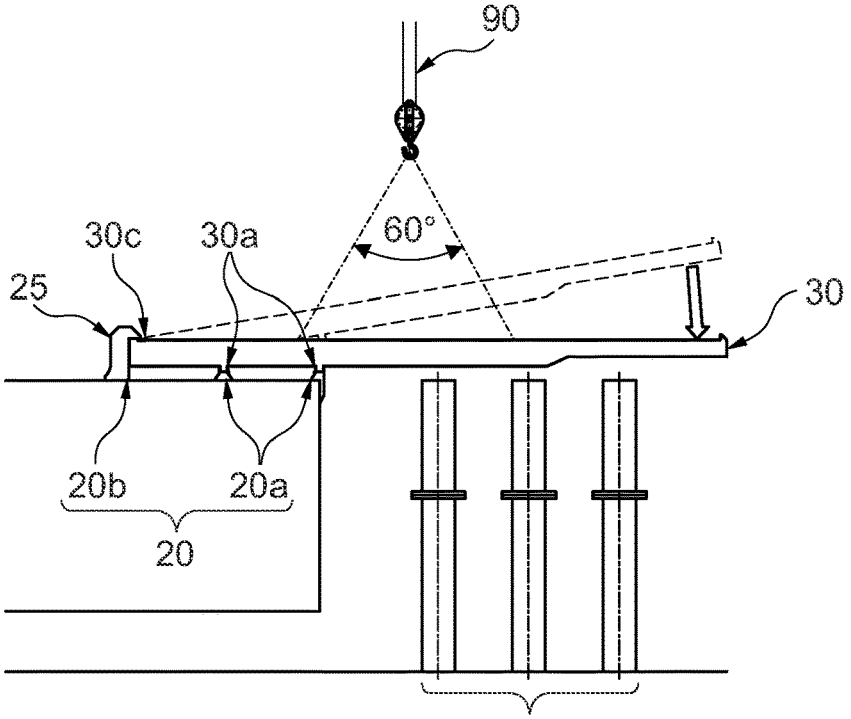
FIG. 12 shows a second assembly step of the at least two cantilever beams with link beam at the transverse beams.

In step S4 of the method 200 of FIG. 15 and as seen in FIGS. 11 and 12, the cantilever beams 30 with the link beam 60 are assembled at the transverse beams 20 using the crane 90. FIG. 11 shows a first part of step S4 at which the cantilever beams 30, mounted with the link beam 60 in between, are hooked and raised by the crane 90 to a position close to the transverse beams 20. The crane 90 can position and/or move the cantilever beams 30 with the link beam 60 along the track beams 20*a* and the hold-down beam 20*b* to change the position of the cantilever beams 30 relative to the barge 10. Thus, the cantilever beams 30 can be moved to a position above the well heads 70, as seen in FIG. 2.

In a second part of step S4, as seen in FIG. 12, the cantilever beams 30 with the link beam 60 are attached to the transverse beams 20. For the attachment of the cantilever beams 30, the sliders 30*b* are hooked to the hold-down beam 20*b* while the opposite side of the cantilever beams 30 is lifted. After the sliders 30*b* are attached to the hold-down beam 20*b*, the opposite side of the two cantilever beams 30 is lowered and the rollers 30*a* are attached onto the track beam 20*a*. After the cantilever beams 30 are positioned at the desired location, the cantilever beams 30 are secured with C-clamps 20*c* (not shown in FIG. 12). Alternatively, if the desired position is determined before the attachment of the cantilever beams 30 to the transverse beams 20, the C-clamps 20*c* can be affixed to the track beams 20*a* upfront.

Figure 13:
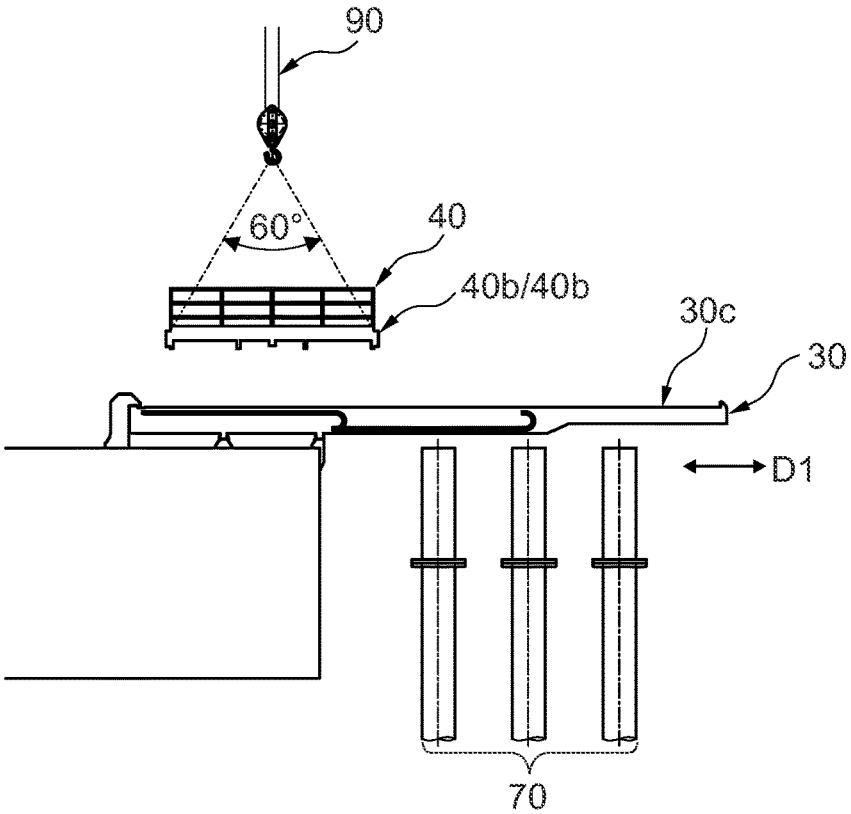
FIG. 13 shows an assembly of a work platform.
Figure 14:
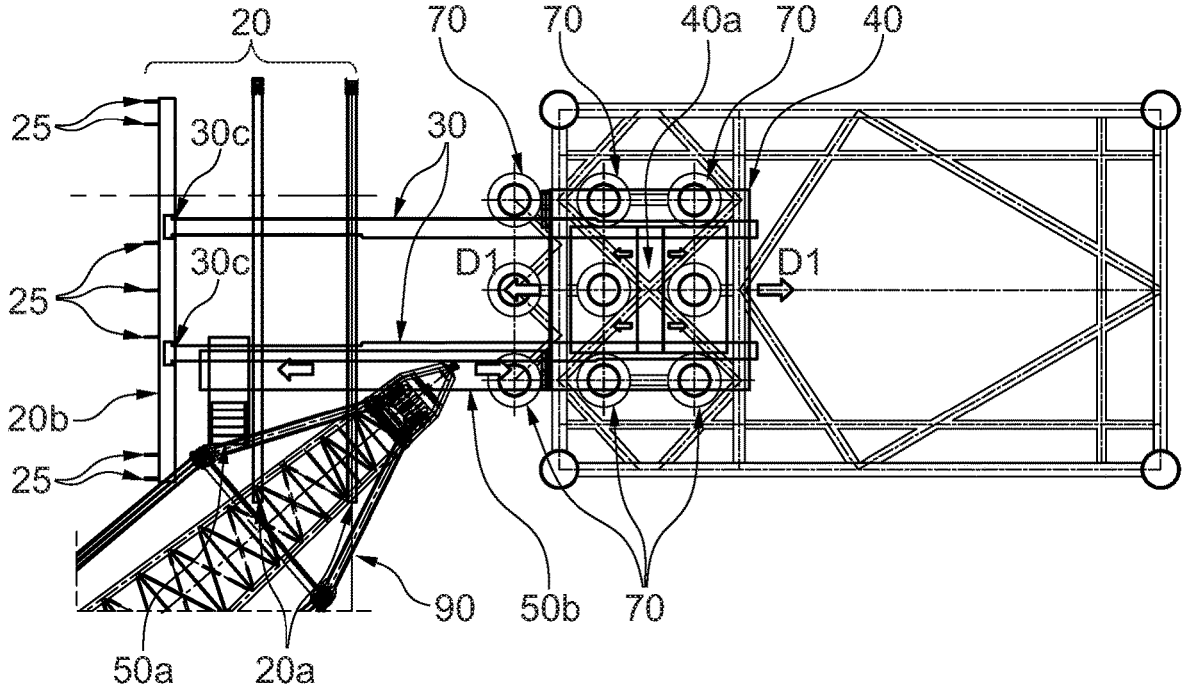
FIG. 14 shows the working deck in an assembled state at a first working position from above.

In step S5 of the method 200 of FIG. 15, as seen in FIG. 13, the work platform 40 comprising the removable floor panels 40*a* is positioned by the crane 90 onto the two cantilever beams 30 in such a way, that the wheels 40*b* of the work platform 40 are positioned on the rails 30*c* of the cantilever beams 30. The wheels 40*b* are driven by the electromotors 40*c* of the work platform 40 which are electrically connected in step S6 of the method 200 of FIG. 15 to a power supply (not shown). The wheels 40*b* are driven by at least one electromotor 40*c* and the work platform 40 is moved in step S7 in a lateral direction D1 to a desired horizontal working position, as shown in FIGS. 2 and 14.

After the work platform 40 arrives at the desired horizontal position, the gangway 50 can be assembled. In step S8 of the method 200 of FIG. 15, the gangway 50 is positioned on the two cantilever beams 30 between the barge 10 and the work platform 40 (see FIG. 2).

For accessing at least one of the offshore well heads 70, one or more of the removable floor panels 40*a* are removed in step S9 before the barge 10 is jacked-down to the desired vertical working position in step S10 of the method of FIG. 15. It will be apparent that steps S9 and S10 can be also changed, such that step S10 is performed before step S9.

To access others of the offshore well heads 70 the work platform 40 can be moved in the lateral direction D1 which also causes an adjustment of the length-adjustable platform member 50*b*. If needed, the barge 10 can be jacked-up/jacked-down between different work positions during operation and or maintenance work.

When the work is finished, the barge 10 is jacked-up above the well heads 70 and the components are disassembled and stored again on the upper surface 11 of the barge 10. After all components are secured the barge 10 is jacked-down and able to continue work at another offshore working location.

REFERENCE SIGNS

10 barge
11 upper surface
20 transverse beams
20*a* track beam
20*b* hold-down beam
20*c* C-clamps
25 stiffening element
30 cantilever beams
30*a* rollers
30*b* sliders
30*c* rails
40 work platform
40*a* removable floor panels
40*b* at least one wheel
40*c* at least one electromotor
50 gangway
50*a* stair member
50*b* length-adjustable platform member
60 link beam
70 well head
80 jack-up mechanism
90 crane
100 working deck
D1 lateral direction
D2 forward direction

The invention claimed is:

1. A working deck configured to access offshore well heads, the working deck comprising:

a barge having an upper surface, wherein the upper surface of the barge is parallel to a surface of water on which the barge is floating; and transverse beams fixed to the upper surface of the barge; wherein:

the working deck comprises at least two cantilever beams attachable on to the transverse beams; and a work platform comprising removable floor panels for accessing the well heads, wherein the work platform is positioned on the at least two cantilever beams and being movable in a lateral direction of the cantilever beams wherein the transverse beams are oriented perpendicular to a forward direction of the barge and comprise at least one of a track beam and one of a hold-down beam for receiving the at least two cantilever beams, wherein the at least two cantilever beams are able to be moved along the at least one track beam and the hold down beam to change the position of the at least two cantilever beams relative to the barge, wherein the working deck comprises a plurality of stiffening elements for stiffening the hold-down beam and to prevent or limit deformation of the hold-down beam.

2. The working deck of claim 1, wherein at least two track beams are in the form of a rail and/or the at least two track beams and one hold-down beam are fixed to the upper surface of the barge and/or the at least two track beams and one hold-down beam are structurally designed to have tracks or rails that allow the cantilever beams to move on them in a lateral direction.

3. The working deck of claim 1, wherein the hold-down beam is oriented perpendicular to a forward direction of the barge and/or is designed to limit a length of penetration of the cantilever beams on the barge.

4. The working deck of claim 1, wherein the stiffening elements are configured to prevent deformation of the hold-down beam to pending moment and shear forces that act on the hold down beam by providing an opposing moment reaction as well a vertical reaction force to counter the shear forces.

5. The working deck of claim 1, wherein:

the at least two cantilever beams are connected with a link beam mounted therebetween.

6. The working deck of claim 5, wherein the link beam is configured to define a rigid position of the two cantilever beams relative to each other and/or is configured to ensure that the cantilever beams are oriented parallel to each other.

7. The working deck of claim 1, wherein:

the at least two cantilever beams further comprise rollers for rolling on the at least one track beam of the transverse beams.

8. The working deck of claim 7, wherein the rollers enable the cantilever beams to roll on the track beams and/or the rollers are configured to withstand high forces and loads.

9. The working deck of claim 1, wherein:

the at least two cantilever beams further comprise sliders, for sliding along the hold-down beam of the transverse beams.

10. The working deck of claim 9 wherein the sliders are made of the same material as the hold-down beam.

11. The working deck of claim 1, wherein:

the at least one track beam further comprise C-clamps for holding a position of the at least two cantilever beams on the at least one track beam.

12. The working deck of claim 1, wherein the at least two cantilever beams further comprise rails, wherein the work platform can be moved along the rails.

13. The working deck of claim 1, wherein:

the work platform further comprises at least one wheel driven by at least one electromotor for moving the work platform on rails of the at least two cantilever beams.

14. The working deck according to claim 13, wherein the wheel is positioned on the rails of the cantilever beams for moving the work platform along the cantilever beams in the lateral direction.

15. The working deck of claim 1, further comprising:

a gangway positioned on the at least two cantilever beams, comprising a stair member and a length-adjustable platform member.

16. The working deck of claim 15, wherein length-adjustable platform member can be adjusted in length in the lateral direction and/or the stair member helps to overcome a height difference between the upper surface of the barge and the work platform.

17. The working deck of claim 15, wherein the gangway is positioned onto at least one of the two cantilever beams between the barge and the work platform.

18. The working deck of claim 1, wherein:

the barge further comprises a jack-up mechanism for jacking-up the barge above the well heads and for jacking-down the barge to a desired vertical working position.

19. A method for accessing offshore well heads with a working deck, the method comprising:

positioning a barge next to the offshore well heads, wherein an upper surface of the barge is parallel to a surface of water on which the barge is floating;

jacking-up the barge to a height above the offshore well heads;

mounting a link beam between at least two cantilever beams;

attaching the at least two cantilever beams to transverse beams fixed to the barge;

positioning a work platform with removable floor panels on the at least two cantilever beams;

electrically connecting at least one electromotor of the work platform;

moving the work platform in a lateral direction to the at least two cantilever beams to a desired horizontal working position by using the at least one electromotor;

positioning a gangway on the at least two cantilever beams between the barge and the work platform;

removing of ones of the floor panels at the work platform for accessing the offshore well heads; and jacking-down the barge over the offshore well heads to a desired vertical working position.

20. The method of claim 19, wherein:

the positioning of the at least two cantilever beams on the transverse beams is carried out in such a way that rollers of the at least two cantilever beams roll on at least one track beam of the transverse beams and a slider of the at least two cantilever beams slides along a hold-down beam of the transverse beams.

21. The method of claim 19, further comprising:

fixing the at least two cantilever beams attached to the transverse beams with C-clamps.

22. The method according to claim 19, wherein the cantilever beams are dissembled and/or stored in a 40 ft ISO container.

23. The method according to claim 19, wherein when the working deck is not used, the transverse beams are oriented and fixed perpendicular to a forward direction of the barge, the cantilever beams, the link beam and the gangway are disposed and secured on an upper surface of the barge in a location reachable with a crane when the barge is moving to the offshore well heads.

* * * * *